United States Patent [19]

Freliech

[11] Patent Number: 4,558,306

[45] Date of Patent: Dec. 10, 1985

[54] CONTACT MONITOR-ANNUNCIATOR

[75] Inventor: Robert A. Freliech, Fayetteville, N.Y.

[73] Assignee: Carrier Corporation, Syracuse, N.Y.

[21] Appl. No.: 553,732

[22] Filed: Nov. 21, 1983

[51] Int. Cl.[4] ..... G08B 23/00

[52] U.S. Cl. ..... 340/520; 62/127; 62/129; 123/41.15; 340/648; 340/652; 340/663

[58] Field of Search ..... 340/648, 520, 644, 652, 340/660, 663; 62/127, 129; 123/41.15

[56] References Cited

U.S. PATENT DOCUMENTS

| | | | |
|---|---|---|---|
| 3,611,364 | 10/1971 | Jones | 340/520 |
| 3,696,364 | 10/1972 | Lavelle | 340/644 X |
| 3,854,089 | 12/1974 | Emler | 340/663 X |
| 4,228,427 | 10/1980 | Niedermeyer | 340/663 X |
| 4,247,849 | 1/1981 | Morris et al. | 340/660 |
| 4,498,077 | 2/1985 | Richardson | 340/652 X |

*Primary Examiner*—James L. Rowland
*Assistant Examiner*—Daniel Myer
*Attorney, Agent, or Firm*—David J. Zobkiw

[57] ABSTRACT

A contact monitor and annunciator unit for providing a persistent warning in the event one of a selected number of event monitoring circuits associated with a mobile refrigeration system opens. The unit includes a number of warning circuits that are electrically isolated from the monitoring circuits by optical isolators and a separate power supply so that the initial cause of a shut down due to abnormal operating conditions can not only be annunicated but also differenciated from a shut down caused by a momentary power failure.

5 Claims, 1 Drawing Figure

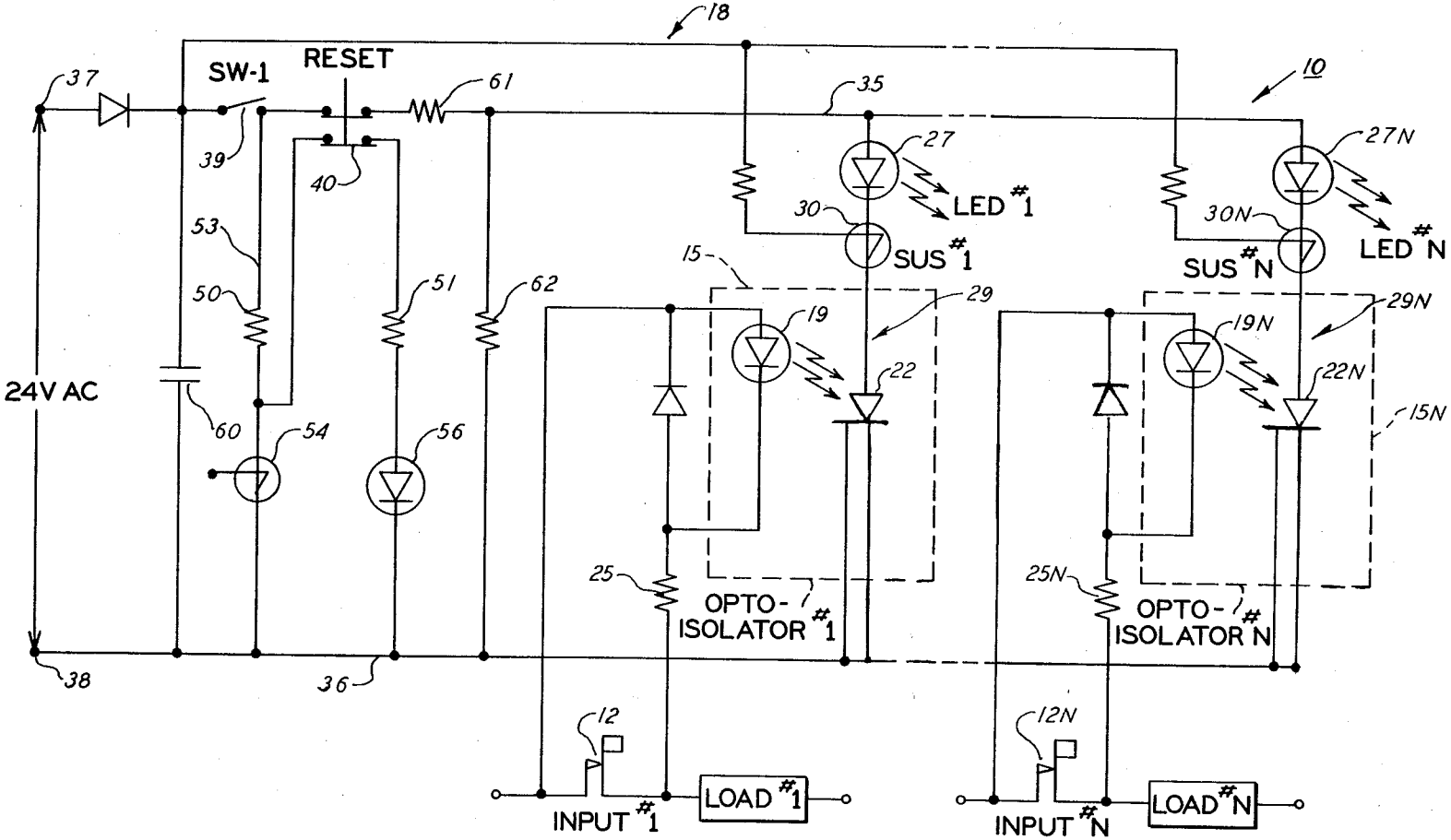
10
18
LED #N
27N
SUS #N
30N
29N
15N
22N
19N
OPTO-ISOLATOR #N
25N
12N
INPUT #N
LOAD #N
LED #1
27
SUS #1
30
35
29
22
19
15
OPTO-ISOLATOR #1
25
12
INPUT #1
LOAD #1
62
61
51
56
RESET
40
36
SW-1
39
53
50
54
60
37
24V AC
38

CONTACT MONITOR-ANNUNCIATOR

BACKGROUND OF THE INVENTION

This invention relates to a contact monitor and annunciator for producing a persistent indication when one of a selected number of monitoring circuits opens due to an abnormal operating condition and which is further able to differentiate an abnormal condition from a momentary power failure.

When transporting perishable cargo in containers, such as mobile trailers, it is necessary to maintain the cargo temperature within a prescribed range to prevent spoilage of the goods in transit. The refrigeration unit that services the container is usually part of the mobile equipment and travels with the container as it is moved from place to place. Climate control can thus be maintained at all times when the container is being transported either by truck, rail or ship.

The containers, particularly when shipped by rail or boat, may remain unattended for relatively long periods of time during which engine related faults can take place. Although the refrigeration equipment is usually shut down immediately upon the detection of a fault, the exact nature of the abnormal condition might not be easily detected. For example, where the fault is caused by an overheating condition or a circuit overload, the cause of the failure will usually abate by the time the shut down is noticed and, if not corrected, reoccur when the equipment is placed back upon the line.

Copending application Ser. No. 497,441 which issued as U.S. Pat. No. 4,498,077, Feb. 5,1985 and Ser. No. 497,460 which issued as U.S. Pat. No. 4,502,084, Feb. 26, 1985, both of which were filed May 23, 1983 and which are assigned to the present assignee, disclose apparatus that is capable of detecting the failure of one of the selected event monitoring circuits and providing an indicator signal that persists after shut down. Both of the disclosed systems are adapted to monitor normally closed contacts in the monitoring circuits and respond to the opening of any one of the contacts to initiate a shut down of the refrigeration equipment. The equipment remains shut down until such time as the operator corrects the fault and resets the faulted circuit. Although the prior art annunciators operate quite well and go a long way toward pinpointing the exact cause of a particular fault, they nevertheless can, under certain conditions, give erroneous information concerning a malfunction. Momentary electrical power interruptions, for example, not caused by any abnormal conditions, can be of sufficient magnitude to open one or more of the monitoring contacts thus giving a faulty indication to the operator. A good deal of time and effort may be spent in trouble shooting the equipment before it is determined that it is in working order.

SUMMARY OF THE INVENTION

It is therefore an object of the present invention to improve systems for monitoring and annunciating motor faults in mobile refrigeration units.

A further object of the present invention is to electrically isolate the annunciator circuits of an engine monitoring and annunciating system from the monitoring circuits of the system so that engine malfunctions can be separated from electrical power failures.

Another object of the present invention is to provide a contact monitor and annunciator system for use in a mobile refrigeration unit that can be quickly and easily reset after a momentary electrical power interruption.

A still further object of the present invention is to provide a motor monitor and annunciator unit for use in a mobile refrigeration unit that can accurately discern the difference between a momentary electrical power failure and an engine malfunction.

Yet another object of the present invention is to record and hold a malfunction indication signal in one of a series of monitoring circuits that are adapted to shut down the engine of a mobile refrigeration system upon the occurrence of a malfunction.

These and other objects of the present invention are attained by means of a contact monitor-annunciator that is adapted to detect the opening of a contact in a plurality of circuits for monitoring a selected number of engine related functions in a mobile refrigeration unit. An annunciator circuit is optically coupled to each of the monitoring circuits which generates a persistent fault indication whan a malfunction is detected in one of the monitored circuits. The independent electrical power supply connected to the annunciator circuits contains a circuit that is adapted to turn on an LED in the event power to the circuits is interrupted. Once turned on, the LED will remain lit until a reset procedure is carried out thus providing the operator with a clear indication of a power interruption.

BRIEF DESCRIPTION OF THE DRAWING

For a better understanding of these and other objects of the present invention reference is now had to the following detailed description of the invention which is to be read in conjunction with the accompanying drawing which is a schematic diagram of a monitoring and annunciating system suitable for use in mobile refrigeration equipment of the type used in shipping containers having an air conditioning system as an integral part of the mobile unit.

DESCRIPTION OF THE INVENTION

Turning now to the drawing, there is shown an electrical diagram of a contact monitor and annunciator system, generally referenced 10, that is suitable for use in a mobile container for transporting perishable goods such as foodstuffs and the like. As is well known in the art, the mobile container is equipped with an engine driven refrigeration or air conditioning unit for controlling climatic conditions inside the container. The refrigeration equipment is adapted to be transported with the container regardless of the shipping mode. The engine, which can be electrical or gasoline powered, is subject to all the problems associated with internal combustion engines and which might include but are not limited to overloading, overheating, lack of lubrication and the like. In light of the fact that the container equipment may remain unattended for relatively long periods of time, monitoring circuits are usually provided to watch over selected engine related functions or events. The monitoring circuits may vary in number, depending on the specific application, but normally each circuit will contain a normally closed sensing contact that will remain closed during periods of normal operation. The contacts open when the circuit senses a malfunction thereby causing the equipment to shut down.

As noted above, some of the later units are now equipped with annunciator circuits that are able to provide an indicator signal that persists after shut down that tells the operator which event or function initially experienced a fault leading to shut down. This, of course, saves a good deal of time that would ordinarily be spent trouble shooting the equipment. The annunciator circuits are typically wired directly into the monitoring circuits and are thus subject to a good deal of background noise and the like which might produce erroneous signals. More importantly because the circuits are not isolated, any momentary interruption of power to the monitoring circuit will be recorded by the annunciator as a system fault. Attempting to separate a true fault from a minor power interruption can oftentimes consume a good deal of time which might place the perishable cargo in danger.

The present contact monitor and annunciator system is arranged to isolate the annunciator circuits from the contact monitoring circuits so that momentary power losses can be identified and separated from shut downs caused by a malfunction of the monitored event.

With reference to the drawing there is illustrated a series of normally closed sensing contacts 12–12N that are connected in series with an equal number of engine related functions or events. The number of functions or events may vary in each application, however, the sensing and annunciating circuitry for each remains basically the same. For explanatory purposes, the subject functions or events that are monitored are simply designated loads 1 through N. The normally closed contact 12–12N associated with each function or event is adapted to respond to a sensor in the load circuit and open when an abnormal operating condition is detected.

Each of the sensing contacts is connected to an optical isolator 15–15N that is adapted to optically couple the monitoring circuits to an independent annunciator circuit generally depicted 18. An infrared emitting diode 19–19N is contained on the input side of each isolator and is arranged, upon firing, to send an optical signal to a light activated silicon controlled rectifier (SCR) 22–22N found in the output side of each optical isolator. Upon the opening of a sensing contact, current flows through the LEDs 19–19N causing the infrared emitting diode on the input side of the attached isolator to fire. This, in turn, excites the companion SCR causing it also to fire.

The annunciator circuit 18 includes a plurality of memory circuits 29–29N equal in number to the number of engine related functions monitored. Each memory circuit is electrically connected to the output side of one of the optical isolators. The memory circuits each contain a light emitting diode (LED) 27–27N and a silicon unilateral switch (SUS) 30–30N. The LED and SUS contained in each memory circuit are wired in series with the associated optically excited SCR between power lines 35 and 36. The power lines are connected via input terminals 37 and 38 to a suitable 24 volt source AC control power. As can be seen, through use of the optical isolators and the independent source of control power, the annunciator circuit and its associated memory circuits are electrically removed from the event monitoring circuits.

A pair of switches are contained in control power line 35 which include a first on-off switch 39 and a second reset switch 40. Closing of the on-off switch 39 causes DC voltage to be applied to the power lines. The values of resistors 50 and 51 are selected so that when the switch is initially closed, there will be insufficient voltage on line 53 to fire unilateral switch 54. A path for current is, however, provided through resistor 51 and light emitting diode 56 which cause the diode to light. This provides a visual indication power to the annunciator memory circuits has been interrupted and that the circuit must be reset. The circuits will remain de-energized until the reset button 40 is depressed. This de-energizes the LED 56 and allows sufficient voltage to be dropped over unilateral switch 54 so that it now fires. Switch 54, as are all the SUS devices used in the circuit, is a silicon planar monolithic integrated circuit device having characteristics that closely parallel those of an ideal four layer diode. The switch is designed to close at a selected threshold voltage and remain closed. After SUS 54 fires, LED 56 cannot turn on and sufficient power is now applied to the memory circuits to permit firing of the unilateral switches 30–30N contained therein.

Should power to the annunciator power lines be momentarily interrupted, SUS 54 will be de-energized and LED 56 again turned on. The LED will remain in an "on" condition until the reset button is depressed thereby initiating a new start up cycle. It should be noted, however, the operator will be visually alerted to the fact that the shut down was not due to an abnormal engine condition but simply caused by a short power interruption.

As illustrated in the drawings, the light emitting diode 27–27N, silicon unilateral switch 30–30N and silicon control rectifier 22–22N making up each of the memory circuits are placed in series between the two power lines 35 and 36. With power provided to the lines and the source capacitor 60 fully charged, the memory circuits are in condition to record the occurrence of a malfunction in any of the selected engine related functions or events should one of the contacts 12–12N open. Resistors 61 and 62 form a voltage divider network in the annunciator circuit. In the event one of the sensing contacts open, the SCR in the coupled memory circuit will fire thereby providing a current path through the circuit. This, in turn, allows the threshold voltage of the SUS to be exceeded and it fires whereupon the LED turns on indicating exactly which of the monitored engine related functions or events has malfunctioned. Turning on the LED causes a voltage to be dropped over resistor 61 in the divider network thus reducing the amount of voltage available to the non-energized memory circuits. Sufficient voltage is dropped over the resistor to prevent the SUS in the non-energized circuits from firing whereby these circuits will remain inactive as long as the initially lighted LED stays on. The energized SCR and SUS are now latched in an "on" condition and will remain so after the engine has been shut down. To turn the LED off, the reset button is depressed to initiate a new turn on procedure.

As should be evident from the disclosure above, once one of the memory circuits has energized due to an abnormal operating condition, subsequent opening of further event sensing switches, which occur during shut down, will not be recorded. Accordingly, the operator by checking the warning lights will be able to tell first and foremost whether the fault was caused by a momentary power failure and, if not, which monitored event initially failed and thus caused the shut down.

While this invention has been described with reference to the structure disclosed herein, it is not confined to the details set forth and this application is intended to cover any modifications or changes as may come within the scope of the following claims.

I claim:

1. In a mobile refrigeration unit, apparatus for identifying a fault in one of a plurality of engine related functions that includes a monitoring means that includes:

(a) a plurality of monitoring circuits connnected to the engine to monitor different engine related functions, (b) actuating means in each monitoring circuit for energizing the said circuit when a fault in the monitored function occurs, (c) a light emitting means in each monitoring circuit for providing an optical output signal when the circuit is energized, an annunciator means that includes:

(a) a plurality of warning circuits equal in number to the number of monitoring circuits, each warning circuit containing an indicator means, and a light activated means for optically coupling the warning circuit to one of said monitoring circuits, (b) an independent power supply connected to the warning circuits to energize the indicator means when an optical signal is received by the light activated means, (c) a unilateral switch in series with the indicator means and said light activated means for holding the said indicator means energized after the optical output signal is terminated, and (d) current limiting means connected between the power supply and each of the warning circuits for preventing a second indicator means from being energized after a first indicator means is energized.

2. The apparatus of claim 1 that further includes a sensing circuit connected between the independent power supply and the warning circuits that open a manually operated reset means when the power supply is interrupted, and an alarm means that is automatically triggered when power is restored.

3. The apparatus of claim 1 wherein the unilateral switch is a silicon unilateral switch (SUS) and the light activated means is a silicon control rectifier (SCR).

4. The apparatus of claim 3 wherein said current limiting means is a dropping resistor that is arranged to drop sufficient voltage upon the firing of one of the silicon unilateral switches to prevent the firing of a second silicon unilateral switch.

5. The apparatus of claim 1 wherein the indicator means in each warning circuit is a light emitting diode (LED).

* * * * *